United States Patent [19]

Uchida et al.

[11] 4,172,462

[45] Oct. 30, 1979

[54] COIN SELECTING AND COUNTING MACHINE

[75] Inventors: Isamu Uchida; Kenkichi Watanabe, both of Tokyo, Japan

[73] Assignee: Laurel Bank Machine Co., Ltd., Tokyo, Japan

[21] Appl. No.: 858,195

[22] Filed: Dec. 7, 1977

[30] Foreign Application Priority Data

Dec. 9, 1976 [JP] Japan ..... 51-148153
Dec. 9, 1976 [JP] Japan ..... 51-148154

[51] Int. Cl.[2] ..... G07F 3/04

[52] U.S. Cl. ..... 133/3 A; 133/8 R; 133/3 H

[58] Field of Search ..... 133/3 R, 3 A, 3 E, 3 H, 133/8 R

[56] References Cited

U.S. PATENT DOCUMENTS

| | | | |
|---|---|---|---|
| 1,813,841 | 7/1931 | Fast | 133/3 R |
| 1,894,190 | 1/1933 | Myers | 133/3 R |
| 2,881,975 | 4/1959 | Bower | 133/8 R X |
| 4,041,280 | 8/1977 | Ohsako et al. | 133/8 RX |

FOREIGN PATENT DOCUMENTS 29759 8/1974 Japan .

*Primary Examiner*—Joseph J. Rolla
*Attorney, Agent, or Firm*—Stevens, Davis, Miller & Mosher

[57] ABSTRACT

A coin selecting and counting machine of reduced size, in which a plurality of coin selecting units are stacked one above another to have a common axis so that coins having the larger diameters may be selected step by step by the higher coin selecting units. The coins thus selected in accordance with their various denominations can be selectively deposited into different containers after their respective numbers have been counted. Each of the coin selecting units includes a rotatable disc made rotatable on the common axis, a separating ring arranged in a stationary position coaxially above the rotatable disc and partially removed to form a coin outlet opening, a coin selecting path leads from this opening and coin selecting rails are arranged at both sides of the path for selecting such coins having a diameter larger than a preset level. Also disclosed is a coin counting mechanism having a star wheel for counting the number of the selected coins, and a coin guiding path for guiding the coins, these coins have diameters smaller than the preset level as fail to be selected by the selecting rails and pass onto the rotating disc of the unit of the next stage positioned below.

9 Claims, 15 Drawing Figures

COIN SELECTING AND COUNTING MACHINE

BACKGROUND OF THE INVENTION

1. Field of the Invention

The present invention relates to a coin selecting and counting machine for automatically selecting a number of coins of varying denominations having different diameters and thicknesses in a correct manner at a high speed and for depositing the same selectively into different containers after their respective numbers have been counted.

2. Description of the Prior Art

The conventional machine of such type has failed to select and count the coins of varying denominations having a large difference in their thicknesses. This is because the thickness regulating member for feeding the coins one by one to the selecting means is made to have its regulating clearance suited for the thickest coins so that the thinner coins are fed in an overlaid manner to invite a jammed condition before they reach the selecting means. In order to eliminate this problem, another conventional machine has resorted to an intermittent feed system, but the processing speed is not satisfactory.

SUMMARY OF THE INVENTION

It is therefore a primary object of the present invention to provide an improved coin selecting and counting machine of reduced size which is free from the above drawbacks concomitant with the prior art.

Another but major object of the present invention is to provide a coin selecting and counting machine of the above type, in which the thickness regulating member has its clearance reduced in the position facing a rotatable disc and widened progressively toward the coin selecting passage so as to facilitate passage of the coins therethrough while preventing a jammed condition.

A further object of the present invention is to provide a coin selecting and counting machine of the above type, in which a plurality of coin selecting units are stacked one over another to have a common axis so that the coins having a larger diameter may be selected step by step by the higher coin selecting units while restricting the whole size of the machine.

According to a major aspect of the present invention, therefore, there is provided a coin selecting and counting machine comprising: a plurality of coin selecting units, each including a rotatable disc made rotatable on its vertical axis, a separating ring arranged in a stationary position coaxially above the outer circumference of said rotatable disc and partially removed to form a coin outlet opening, a coin selecting path leading from said coin outlet opening, coin selecting means arranged on said coin selecting path for selecting such coins having a diameter larger than a preset level, coin counting means arranged at the trailing end of said coin selecting means for counting the number of the selected coins, and a coin guiding path arranged below said coin selecting means for guiding the coins, which have such diameters smaller than said preset level as fail to be selected by said coin selecting means, onto the rotating disc of the coin selecting unit of the next stage which is arranged below the first-named coin selecting unit, said coin selecting units being stacked one over another to have their rotatable discs arranged on a common axis so that the coins having the larger diameter may be selected step by step by the higher coin selecting units.

DESCRIPTION OF THE DRAWINGS

Other objects and advantages of the present invention will become apparent from the following description taken in conjuction with the accompanying drawings, in which.

DESCRIPTION OF THE PREFERRED EMBODIMENTS

The present invention will now be described in conjunction with the embodiments thereof with reference to the accompanying drawings.

Figure 1:
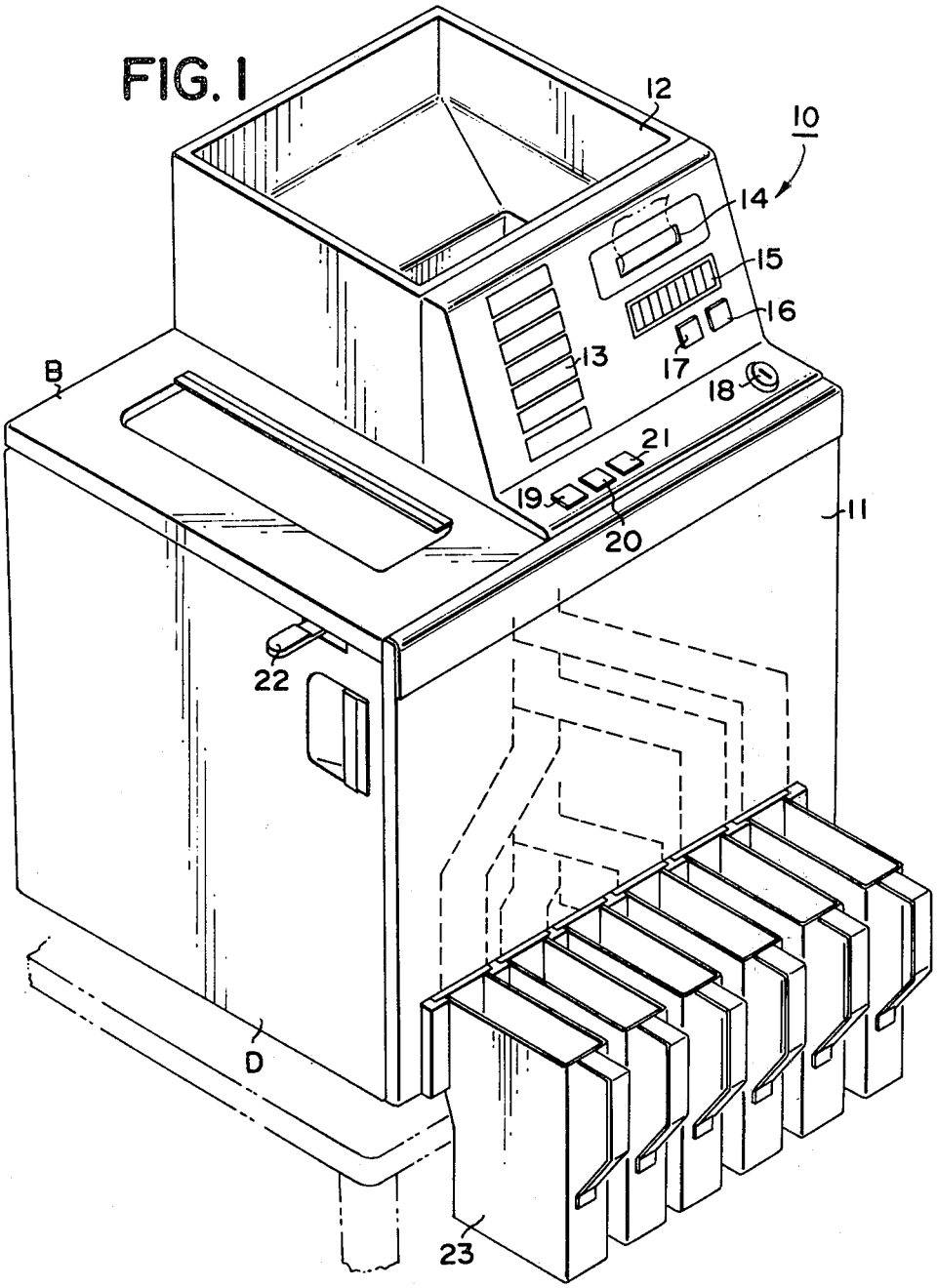
FIG. 1 a perspective view showing the overall construction of the coin selecting and counting machine exemplifying the present invention.

Generally indicated at reference numeral 10 in FIG. 1 is a coin selecting and counting machine which examplifies the present invention. The coin selecting and counting machine 10 includes a body 11 formed with a hopper 12, into which coins of varying denomination are placed. The machine 10 is equipped on its control panel with a plurality of count indicators 13, a take-out opening 14 for recording paper having typed information, a plurality of buttons 15 for setting code numbers, dates and so on, a button 16 for advancement of the recording paper, a type operating switch 17, a key switch 18, a clearing switch 19, a start switch 20, and a stop switch 21 and the like. The machine 10 may be further equipped on its side panel with a release handle 22 which is operative to release the machine 10 from its jammed condition with the coins. A plurality of containers 23 are removably attached to a lower portion of the front panel of the machine 10 so that they may accommodate the selected coins respectively of their denominations.

Figure 2:
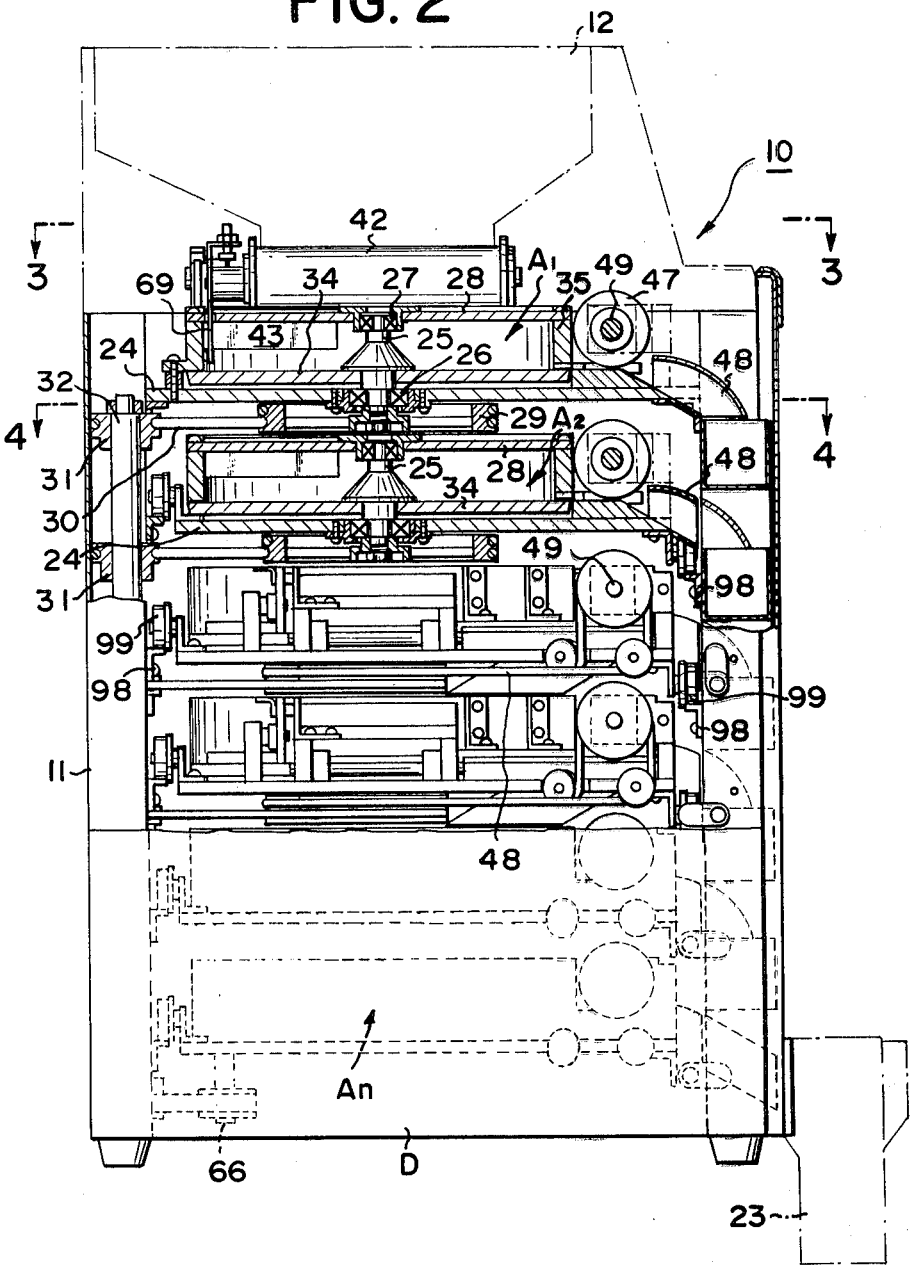
FIG. 2 is a partially cut-away side elevation showing the inside structure of the coin selecting and counting machine of FIG. 1.

Turning now to FIG. 2, there are located inside of the body 11 of the coin selecting and counting machine 10 a plurality of coin selecting units $A_1$ to $A_n$ which are overlaid one over another in the form of multiple stages. These selecting units $A_1$ to $A_n$ are arranged such that the unit $A_1$ for the coins having the maximum diameter is disposed in the uppermost position while the unit $A_n$ for the coins having the minimum diameter is disposed in the lowermost position and that the remaining units $A_2$ to $A_{n-1}$ for the coins having smaller diameters of the specified order are disposed in the lower positions of that order.

The selecting units $A_1$ to $A_n$ thus arranged are separated from the adjacent one by means of a base plate 24. Each of the selecting unit $A_1$ and $A_n$ has its spindle 25 supported rotatably in a bearing 26 mounted in the base plate 24 and in a bearing 27 mounted in a support plate 28.

Each of the spindle 25 is turned through a pulley 29 which is mounted thereto. More specifically, the pulley 29 is driven by the combined actions of a belt 30 and the pulley 31 of an intermediate shaft 32, which in turn is driven at a suitable speed by an electric motor 33 through a pulley and a belt, not numbered in FIGS. 3 and 4. A rotatble disc 34 is fixed at its center to each of the spindles 25 so that it may rotate therewith.

There is arranged above the outer circumference of the disc 34 a separating ring 35, to which is mounted the support plate 28. The separating ring 35 is partially removed to form a coin outlet opening 36 which is made to lead to a coin selecting path 37.

Figure 7:
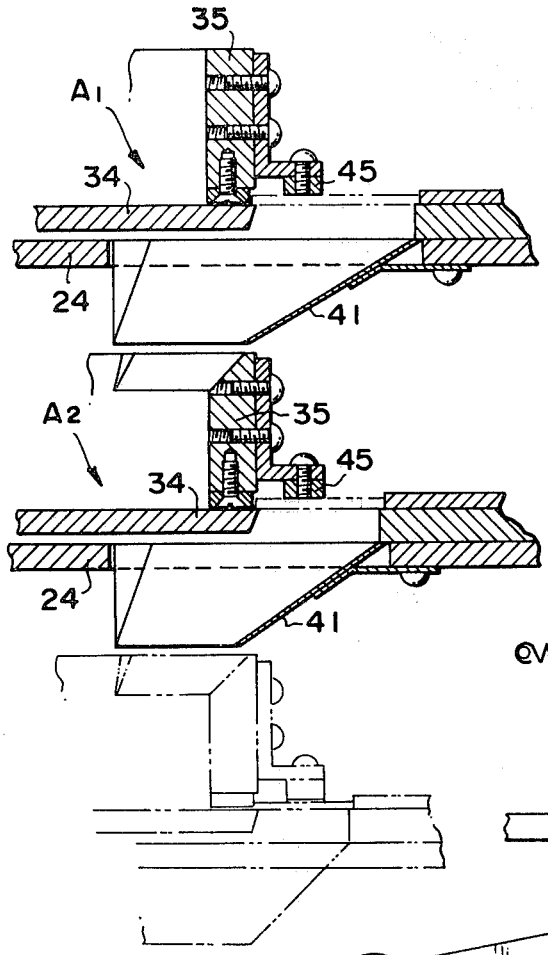
FIG. 7 is a sectional view taken along the line 7—7 of FIG. 3 and shows the construction of a simplified thickness regulating member and the downwardly inclined path leading to the lower selecting unit of the next step.
Figure 10:
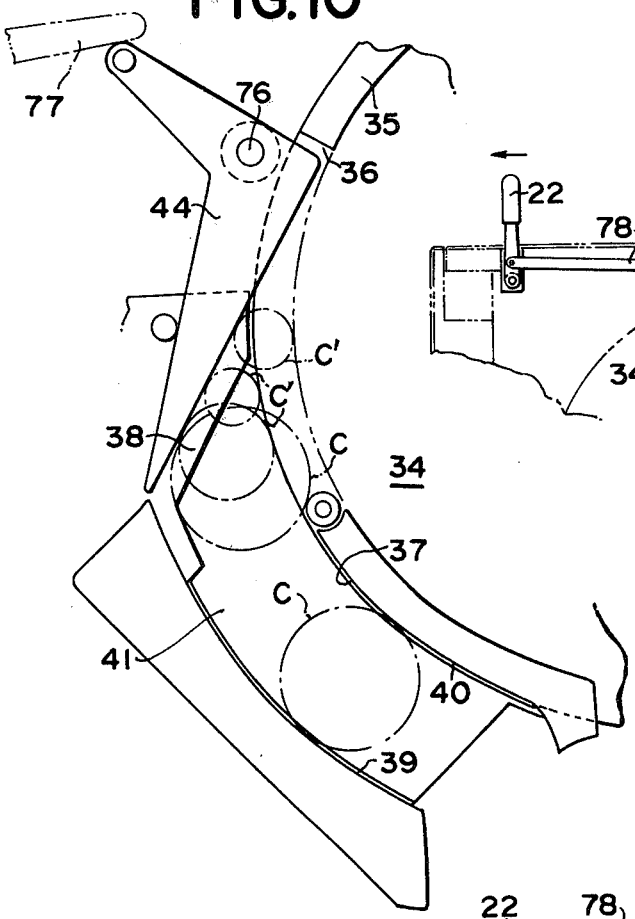
FIG. 10 is a top plan view showing the detailed construction of a coin selecting path for use in the coin selecting and counting machine of the invention.

The selecting path 37 is formed along the circumference of the rotatable disc 34, as better seen from FIG. 10. There are arranged at the both sides of the path 37 a plurality of selecting rails 38, 39 and 40 which are sized and positioned so as to select only the coins C having such a large diameter as can slide past the rails 38 to 40 while riding on them. On the other hand, the coins C' having smaller diameter fail to ride on the rails 38 to 40 to fall down onto a downwardly inclined path or chute 41 so that they may be guided into the next coin selecting unit $A_2$ of the second stage, as better seen from FIG. 7.

Figure 3:
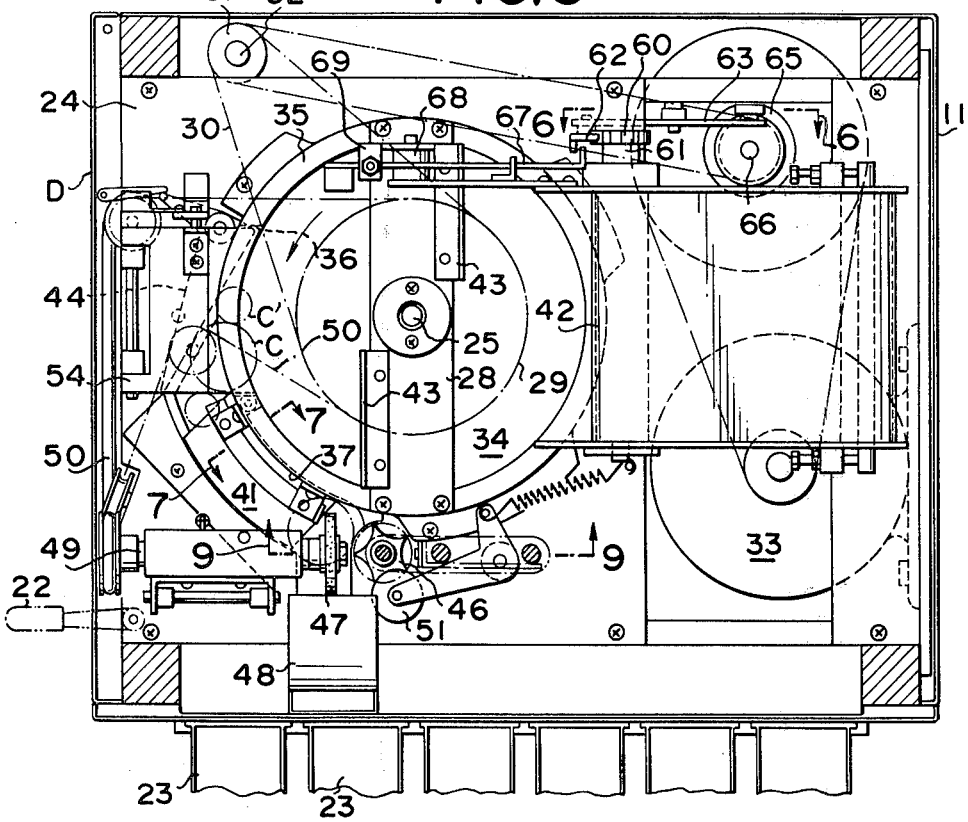
FIG. 3 is a horizontal section taken along the line 3—3 of FIG. 2.
Figure 4:
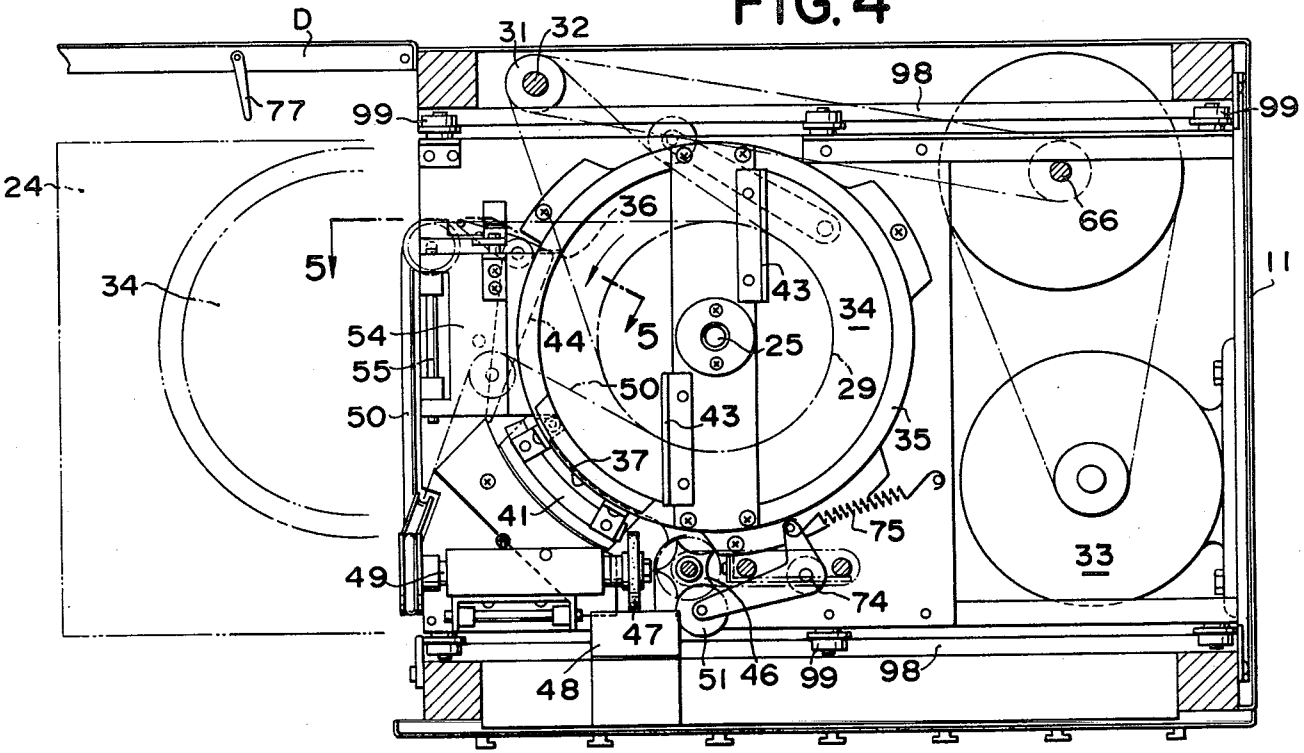
FIG. 4 is similar to FIG. 3 but is taken along the line 4—4 of FIG. 2.

When the coins C and C' of varying denominations are poured into the hopper 12, they are supplied in a suitable mass onto the rotatable disc 34 of the upper most selecting unit $A_1$ by the feeding operation of a supply belt 42. The coins are then thrown radially outwardly of the rotatable disc 34 to the inner circumference of the separating ring 35 by the centrifugal force resulting from the high speed rotations of the disc 34. In this meanwhile, a pair of leveling plates 43, which are fixed radially to the support plate 28, act to level the coins which might otherwise be locally heaped up or take an upright position, as shown in FIGS. 2, 3 and 4.

Thus, the coins moving along the inner circumference of the separating ring 35 come to the position of the coin outlet opening 36, where they are guided into the selecting path 37 along and past a guide member 44, as best seen from FIG. 10. Then, the smaller coins C' fail to ride on the selecting rails 38 to 40 and fall down to the chute 41 which is arranged below the rails 38 to 40. The larger coins C can, however, ride on the rails 38 to 40 to pass the selecting path 37. Along this path 37, moreover, there is provided a thickness regulating member 45 which is mounted to the separating ring 35, as best seen from FIG. 7. This thickness regulating member 45 is sized and positioned to regulate the coins in accordance with their thickness while they are passing the rails 38 to 40. For example, in case both the coins C and C' of larger and smaller diameters are to pass with the latter being laid on the former, the thickness regulating member 45 can block the passage of the smaller coin C'.

Figure 8:
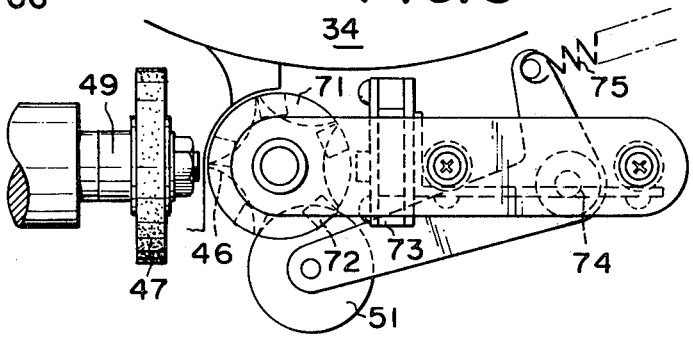
FIG. 8 is a top plan view showing the detailed construction of a coin counting mechanism for use in the coin selecting and counting machine of the invention.
Figure 9:
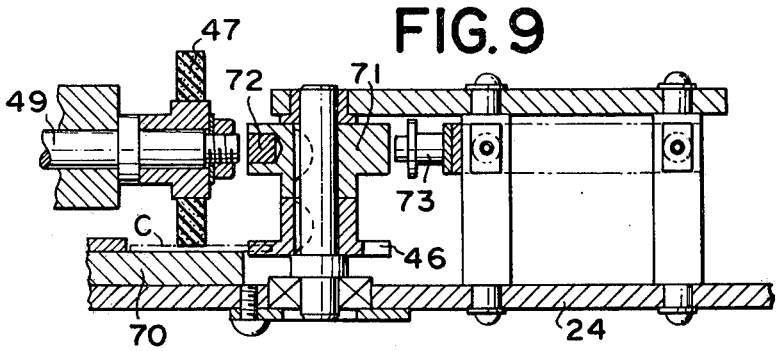
FIG. 9 is a sectional view of the coin counting mechanism of FIG. 8.

The coins are forced, after having passed the selecting path 37, into meshing contact with a star wheel 46 by the action of a feed roller 47 which is disposed at the downward end of the path 37, as shown in 2, 3 and 4 and as better seen from FIGS. 8 and 9, so as to turn the wheel 46 for the counting purpose. The counted number is indicated in one of the count indicators 13, which have been touched in connection with FIG. 1. After this counting operation, the coins are deposited via a chute 48 into one of the containers 23 in a classified manner, as seen from FIGS. 2, 3 and 4.

Here, the shaft 49 of the feed roller 47 is driven by the pulley 29 through a belt 50 and a plurality of idle pulleys, not numbered. Indicated at numeral 51 is a regulating roller which is in regulating contact with one of the notches of the star wheel 46 so as to advance the same one notch in an indexed manner while preventing its idle rotation.

Figure 5:
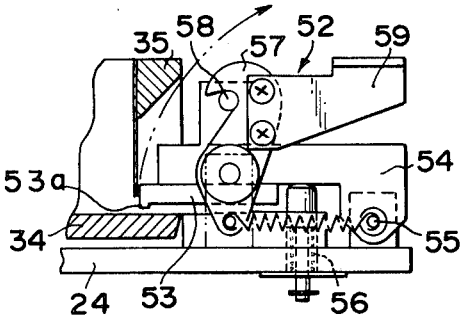
FIG. 5 is a partial section taken along the line 5—5 of FIG. 4 and shows the detail construction of a thickness regulating member for use in the coin selecting and counting machine of the invention.

Turning now to FIG. 5, there is shown in detailed section another embodiment of the thickness regulating member 45. This embodiment is suitable for the case, in which so many coins advance at a time from the coin outlet opening 36 that the downwardly inclined path 41 cannot handle them. In order to eliminate this problem, there is provided an advancement control device 52 which is arranged to face the coin outlet opening 36. More specifically, a thickness regulating member 53 is attached to the support 54, which is pivotally connected to the base plate 24 by means of a pin 55, such that it has an arcuately curved surface to coincide with the inner circumference of the separating ring 35 so as to cover the coin outlet opening 36. The thickness regulating member 53 is formed at its leading outer end with a downward projection 53*a*, which has such a suitable radial width that the remaining lower surface may be recessed to provide a wider clearance for failitating passage of the coins one by one.

The support 54 is biased by the action of a spring 56 in the direction to turn about the pin 55 so as to widen the clearance. This biasing force is normally restricted by the actions of a hook 57, which is pivoted to the base plate 24, and a hook pin 58 which is ancored at the support 54, thus holding the downward projection 53*a* of the member 53 in position. Thus, when the thickness regulating member 53 or its downward projection is jammed with the coin or coins for some cause, then a release lever 59 mounted to the hook 57 is depressed to disengage the hook 57 from the hook pin 58 so that the support 54 may be turned about the pin 55 together with the regulating member 53 by the biasing force of the spring 56 to open the downward projection 53a.

Figure 6:
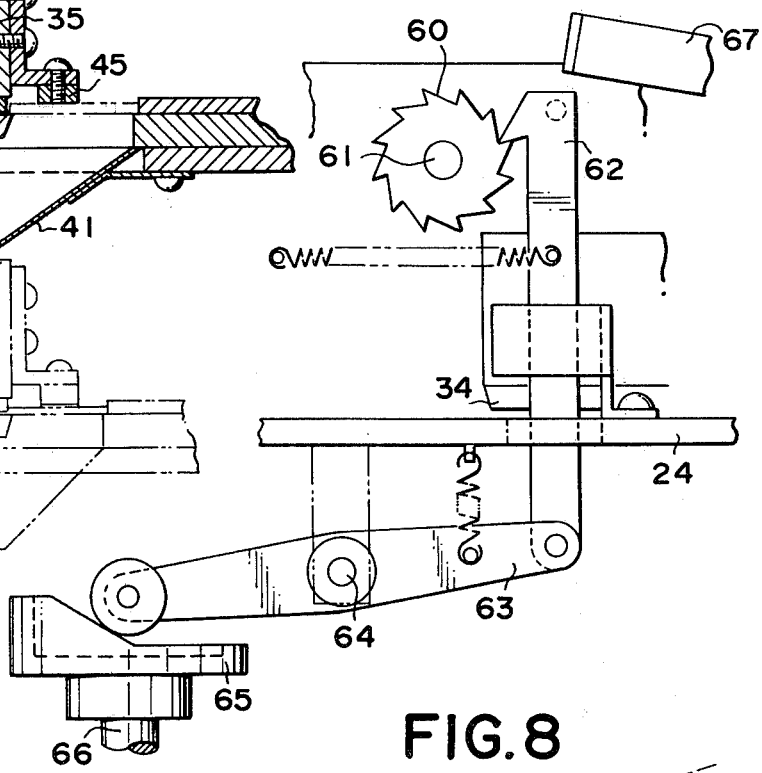
FIG. 6 is a side elevation viewed in the direction of the line 6—6 of FIG. 3 and shows the coin supply mechanism from the hopper to the uppermost coin selecting unit.

The driving mechanism for the supply belt 42 for supplying the coins from the hopper 12 onto the rotatable disc 34 is exemplified and shown in FIG. 6 as well as in FIGS. 2, 3 and 4. As best seen from FIG. 6, a ratchet wheel 60 is mounted to the drive shaft 61 of the belt 42. There is arranged in the vicinity of the ratchet wheel 60 a pawl lever 62, which is joined to one end of a connecting lever 63 which in turn is made swingable about a pivot pin 64. The other end of the connecting lever 63 is in abutment contact with cam 65 of a rotatable shaft 66 so that the pawl lever 62 may be actuated through the connecting lever 63 in response to the rotations of the cam 65 so as to turn the ratchet wheel 60 one tooth or step by step. As a result, the drive shaft 61 and accordingly the supply belt 42 can be turned intermittently or in an indexed motion. There is further provided a restricting lever 67 which is operative to restrict the operation of the pawl lever 62. As better seen from FIGS. 2 and 3, the restricting lever 67 is supported on a shaft 68. A detecting lever 69 is connected to the restricting lever 67 and arranged to face the rotatable disc 34. This detecting lever 69 is made operative to detect the condition, in which many coins are heaped up on the rotatable disc 34, so that its leading end may stop the operation of the pawl lever 62, i.e., release the abutment contact between the connecting lever 63 and the cam 65, thus stopping the operation of the supply belt 42.

The detailed construction of the coin counting mechanism including the feed roller 47 and the star wheel 46 is shown in FIGS. 8 and 9. When a series of the coins are delivered, after having passed the selecting path 37, onto a guide plate 70, then they are forced toward the chute 48 by the action of the feed roller 47 made of rubber until the leading coin comes into engagement with one of the notches of the star wheel 46 to rotationally advance the wheel 46.

There is attached to the star wheel 47 a count wheel 71 which is equipped with count elements 72 made of iron or magnet. The number of these count elements 72 is the same of that of the notches of the star wheel 47. In the vicinity of the outer circumference of the count wheel 71, there is arranged a sensor 73 which is made operative to sense the approach of the count elements 72. This sensor 73 is connected either directly or indirectly via an amplifier or the like to the count indicators 13 and/or a not-shown typing section so as to supply the same with the number of the coins detected thereby.

The regulating roller 51 is rotatably supported by a pin 74 and is biased by a coil spring 75 into elastic engagement with one of the notches of the star wheel 47 so as to prevent the latter from idly rotating.

Thus, the sensor 73 can count the number of the selected coins by the coactions of the count elements 72 while the coins are being fed one by one through the star wheel 47.

Figure 11:
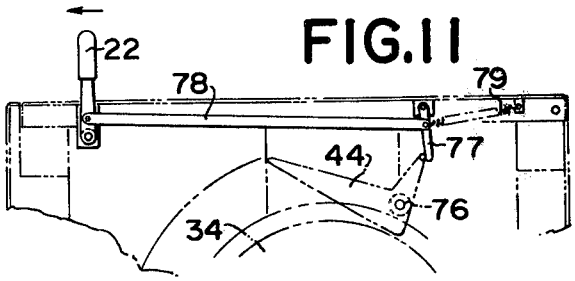
FIG. 11 is a top plan view showing the detailed construction of a manually operative mechanism for releasing a jammed condition of the coin selecting and counting machine of the invention.
Figure 12:
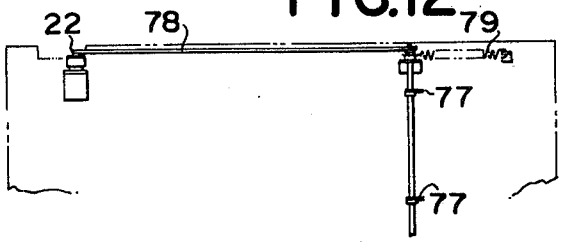
FIG. 12 is a front elevation showing the manually operable mechanism of FIG. 11.

As better seen from FIGS. 11 and 12, the guide member 44 is pivotally supported at a pivot shaft 76 and made to have its one end in abutment engagement with an operating lever 77. This operating lever 77 is connected to the afore-mentioned release lever 22 through a connecting bar 78.

When the coin outlet opening 24 fails to efficiently handle the coins and becomes jammed with stagnant coins, then the release lever 22 is operated to pull the connecting bar 78 against the action of a spring 79 so that the operating lever 77 may turn the guide plate 44 about the pivot pin 75 to return the coins to the rotatable disc 34 so as to release the jammed condition.

Figure 13:
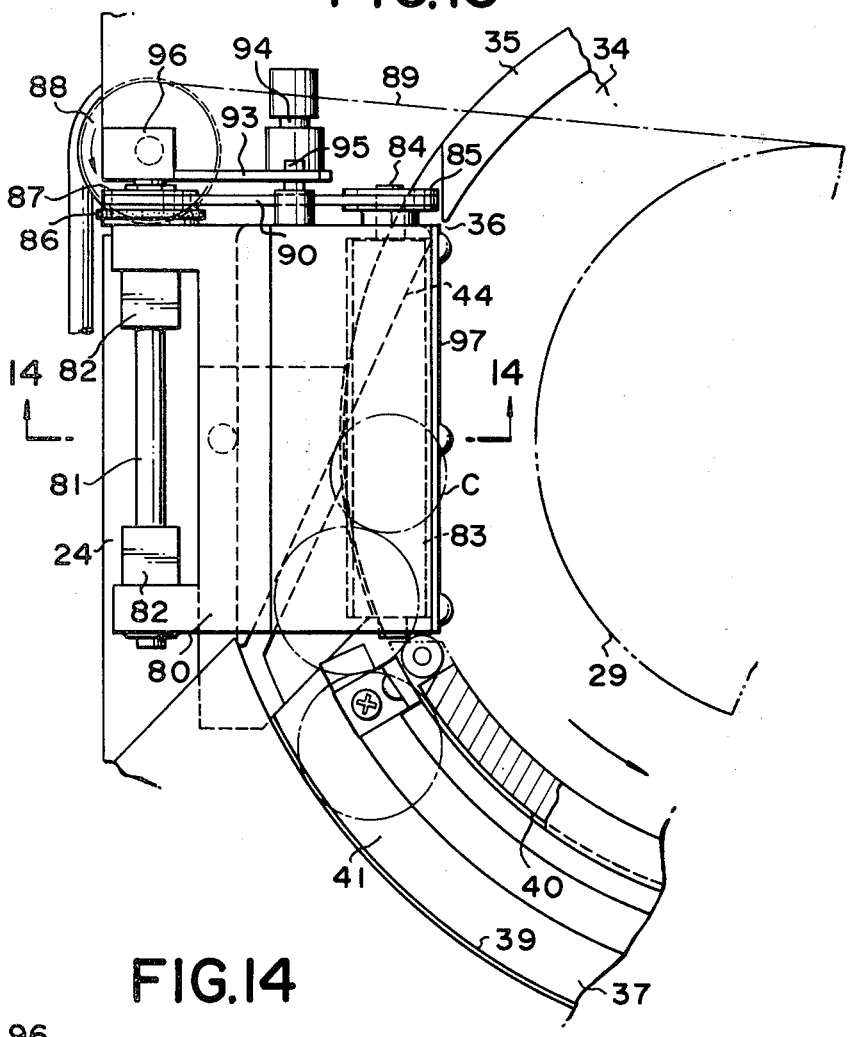
FIG. 13 is similar to FIG. 10 but shows the detailed construction of an automatic mechanism for releasing a jammed condition of the coin selecting and counting machine while acting as the thickness regulating member.
Figure 14:
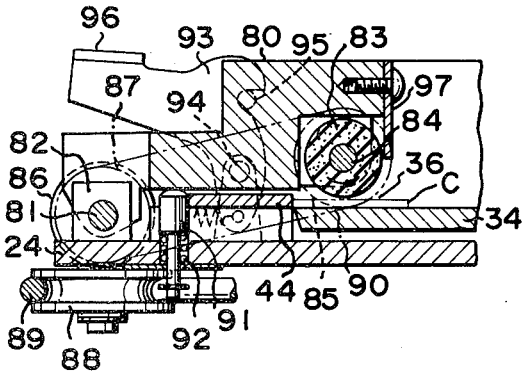
FIG. 14 is a sectional view taken along the line 14—14 of FIG. 13.

Turning now to FIGS. 13 and 14, there is shown another embodiment of jammed condition releasing means, by which the coins can be guided into the coin outlet opening 36 smoothly without any jammed condition while being regulated in their thickness. As shown, a support structure 80, which has its inner end portion facing the opening 36, is pivotally supported on a shaft 81 which in turn is supported in bearings 82 mounted to the base plate 24. In the inner lower portion of the support structure 80, there is mounted a regulating roller 83 which is supported on a shaft 84 and which is equipped with a pulley 85. The regulating roller 83 may desirably be made of a slightly elastic material such as rubber. The spacing between the outer circumference of the roller 83 and the surface of the rotatable disc 34 is adjusted to be substantially equal to the thickness of the coins.

A friction wheel 86 is attached to a pulley 87 which is loosely mounted on the shaft 81. The friction wheel 86 is in pressure contact with the side of an intermediate pulley 88 or the not-shown friction plate which is fixed to that side.

The rotations of the pulley 29 of the rotatable disc 34 are transmitted through a belt 89 to the intermediate pulley 88 so that the regulating roller 83 may be forced to turn in the direction of arrow through the friction wheel 86, the pulley 87, a belt 90, and the pulley 85 and the shaft 84. Incidentally, the support structure 80 is biased to rotate upward through a pin 91 by the action of a coil spring 92 which is mounted to the pin 91. The structure 80 is, however, held in position by the combined actions of a hook 93, which is pivoted to the base plate 24 through a pin 94, and a hook pin 95 which is anchored at the side of the structure 80. Thus, when a push plate 96 is depressed, the engagement between the hook 93 and the hook pin 95 is released so that the support structure 80 may be turned upward about the shaft 81 by the biasing force of the spring 92 so as to open the spacing between the outer circumference of the regulating roller 83 and the surface of the rotatable disc 34. Indicated at numeral 97 is a cover which is attached to the inner side of the support structure 80 to cover the regulating roller 83 so that no coin may enter the upper space above the regulating roller 83.

With this construction, the coins moving along the inner circumference of the separating ring 35 due to the centrifugal force are allowed to enter the coin outlet opening 36 and guided into the coin selecting path 37 by the action of the guide member 44. If the opening 36 is jammed with the overlaid or stagnant coins, these coins are forcibly rejected or repelled to the center of the rotating disc 34 by the action of the regulating roller 83 so that they are allowed to enter the selecting path 37 one by one.

Although the foregoing description has been directed mainly to the uppermost coin selecting unit $A_1$, the remaining units $A_2$ to $A_n$ of the subsequent stages have substantially the same construction excepting the natural slight modifications, as will described in the following. The width of the coin selecting path 37 become the smaller for the lower coin selecting units in accordance with the denominations of the coins to be selected, and at the same time the thickness regulating members 45 and 53 have to be adjusted accordingly. Moreover, the chutes 48 of the respective units are connected to the containers 23, respectively. Here, the lowermost unit $A_n$ may be just the same as the higher units $A_1$ to $A_{n-1}$, but its downwardly inclined path 41 may lead, if desired, to the container 23 directly via the 48 in case no selection is required.

In order to facilitate inside inspection and repair, it is desirable that each of the units can be taken out of the body 11 of the coin selecting and counting machine 10. More specifically, the machine 10 is constructed such that the uppermost unit $A_1$ can be taken out by removing the top cover B of the body 11. For the lower units $A_2$ to $A_n$, there are arranged in the body a pair of rails 98 and a plurality of wheels 99, as shown in FIGS. 1 and 2 and as better seen from FIG. 4. Then, the side cover D of the body 11 is opened so that the desired one of the units $A_2$ to $A_n$ can be taken out of the body 11 together with the base plate 24 without removing the belts 30 and 50.

Figure 15:
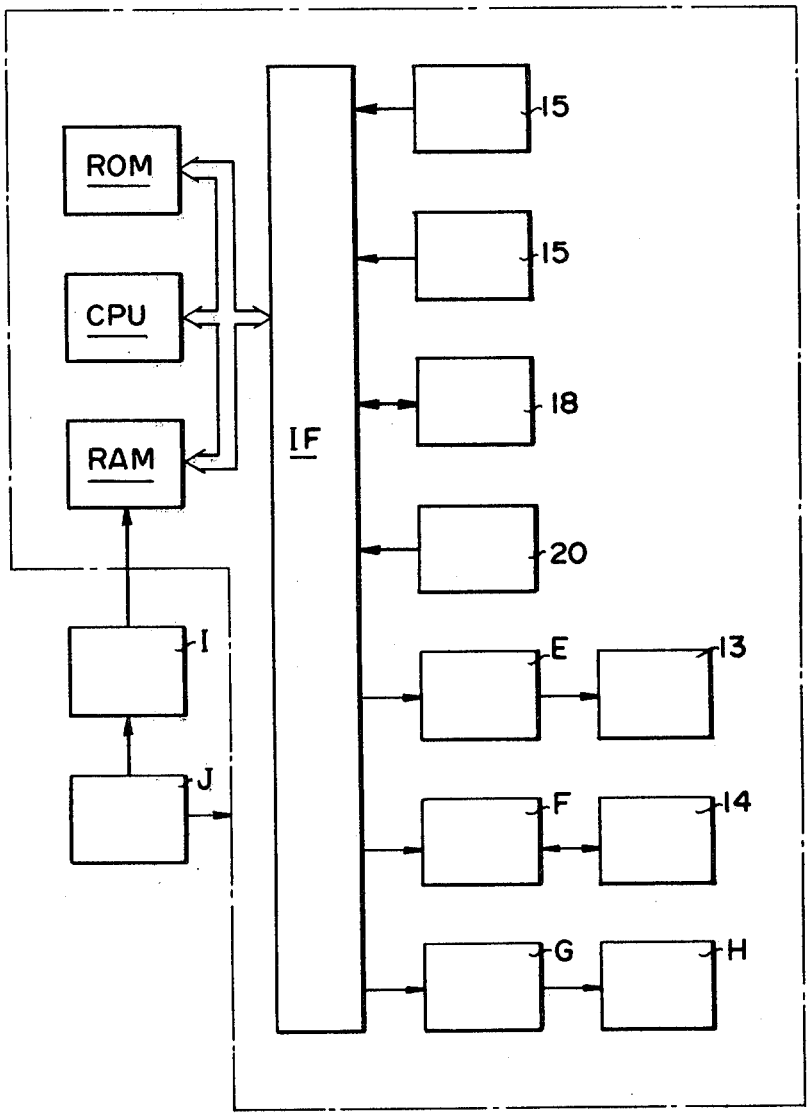
FIG. 15 is a diagrammatical presentation of a preferred embodiment of electric control system which can be used with the coin selecting and counting machine according to the present invention and in which like elements are designated at the same names as those in FIG. 1.

Turning now to FIG. 15, there is shown in a block diagram a preferred operating system which can be used with the coin selecting and counting machine 10 according to the present invention for illustrative purposes only. Thus, it is considered sufficient for those skilled in the art that the elements appearing in the block diagram be named. Letter IF indicates an interface for inputs and outputs, ROM a read-only memory, CPU a central processor unit, RAM a random access memory, E an indication control circuit, F a printer control circuit, G a motor control circuit, H a counting motor, I an emergency power source, and J a power source.

What is claimed is:

1. A coin selecting and counting machine comprising: a plurality of coin selected units, each including a rotatable disc made rotatable on its vertical axis, a separating ring arranged in a stationary position coaxially above the outer circumference of said rotatable disc and partially removed to form a coin outlet opening, a coin selecting path leading from said coin outlet opening, coin selecting means arranged on said coin selecting path for selecting such coins having a diameter larger than a preset level, thickness regulating means arranged along said coin selecting path and sized for regulating the thickness of the coins being selected so that coins may be guided to said coin selecting means, coin counting means arranged at the trailing end of said coin selecting means for counting the number of selected coins, and a coin guiding path arranged below said coin selecting means for guiding the coins, which have such diameters smaller than said preset level as fail to be selected by said coin selecting unit of the next stage which is arranged below the first-named coin selecting unit, said coin selecting units being stacked one over another to have their rotatable discs arranged on a common axis so that the coins having the larger diameter may be selected step by step by the higher coin selecting units, said thickness regulating means including an advancement control device having a thickness regulating member formed with an arcuately curved surface coincident with the inner circumference of said separating ring and at its leading outer end with a downward projection which has such a radial width that the remaining lower surface may be recessed to provide a wider clearance for facilitating passage of the coins one by one.

2. A coin selecting and counting machine according to claim 1, wherein said advancement control device further has means normally holding said thickness regulating means in position and for opening said downward projection when said thickness regulating means becomes jammed with the coins.

3. A coin selecting and counting machine according to claim 1, wherein each of said coin selecting units further includes a guide plate arranged in said coin outlet opening for guiding therealong the coins coming into said coin selecting path, and jammed condition releasing means made manually operable for actuating said guide plate to return the coins to the center of said rotatable disc when said coin outlet opening becomes jammed with the stagnant coins.

4. A coin selecting and counting machine according to claim 1, wherein said coin selecting means has a plurality of selecting rails arranged at the both sides of said coin selecting path and sized and positioned to select only the coins having such a diameter larger than said preset level as can slide past said selecting rails while riding thereon.

5. A coin selecting and counting machine according to claim 1, wherein each of said coin selecting units further includes leveling means having a pair of leveling plates held in a stationary position relative to said rotatable disc for leveling the coins which might otherwise be locally heaped up and take an upright position.

6. A coin selecting and counting machine according to claim 1, wherein each of said coin selecting units further includes jammed condition releasing and thickness regulating means arranged to face said coin outlet opening and having a regulating roller arranged at a spacing substantially equal to the thickness of the coins and made rotatable in the direction opposite to the direction allowing advancement of the coins so as to automatically return the coming coins to the center of said rotatable disc when said coin outlet opening becomes jammed with the overlaid coins thereby to guide the coins one by one into said coin selecting path.

7. A coin selecting and counting machine according to claim 6, wherein said jammed conditions releasing and thickness regulating means further has a cover for covering said regulating roller and for blocking the coins from entering the upper space above said regulating roller.

8. A coin selecting and counting machine according to claim 1, wherein said coin counting means has a star wheel formed with a plurality of notches, with which the coins are fed into meshing contact, a regulating roller biased into regulating contact with one of the notches of said star wheel for advancing the same one notch while preventing the idle rotation thereof, a count wheel attached to said star wheel and equipped with count elements of the same number of said notches, and a sensor arranged in the vicinity of said count wheel for sensing the approach of said count elements to count the number of coins.

9. A coin selecting and counting machine according to claim 8, wherein said coin counting means further has a feed roller for bringing the selected coins into engagement with one of the notches of said star wheel.

* * * * *